United States Patent [19]

Yamamoto et al.

[11] Patent Number: 4,586,679

[45] Date of Patent: May 6, 1986

[54] YARN PACKAGE OF CARBON FILAMENT YARN

[75] Inventors: Ryuichi Yamamoto; Hironobu Nojiri, both of Ehime, Japan

[73] Assignee: Toray Industries, Inc., Tokyo, Japan

[21] Appl. No.: 577,186

[22] Filed: Feb. 6, 1984

[51] Int. Cl.[4] ..... B65H 54/38

[52] U.S. Cl. ..... 242/176; 242/18.1

[58] Field of Search ..... 242/174, 175, 176, 177, 242/178, 18.1, 43 R; 57/99

[56] References Cited

U.S. PATENT DOCUMENTS

| | | | |
|---|---|---|---|
| 2,608,354 | 8/1952 | Whittaker | 242/158.5 X |
| 3,310,248 | 3/1967 | Have | 242/176 X |
| 3,334,828 | 8/1967 | Harrison | 57/99 X |
| 3,606,197 | 9/1971 | Akers | 242/18.1 X |
| 3,718,288 | 2/1973 | Jennings et al. | 242/178 |
| 3,741,491 | 6/1973 | Richter | 242/18.1 |
| 4,296,889 | 10/1981 | Martens | 242/18.1 |

*Primary Examiner*—Stuart S. Levy
*Assistant Examiner*—Katherine Matecki
*Attorney, Agent, or Firm*—Austin R. Miller

[57] ABSTRACT

A package of carbon filament yarn having no slipover tendency upon unwinding thereof, in which a yarn trace formed by a traverse is repeated every n cycles at a predetermined shifting ratio in a range of 50% to 150% relative to the yarn width, n being a positive integer of not more than 9. The package can be obtained by using a conventional spindle drive winder under a selected winding ratio and winding tension.

15 Claims, 5 Drawing Figures

YARN PACKAGE OF CARBON FILAMENT YARN

BACKGROUND OF THE INVENTION

1. Field of the Invention

This invention relates to an improved package of carbon filament yarn, which can be smoothly unwound without generation of fluff and yarn breakage.

2. Description of the Prior Art

Nowadays, carbon filament is utilized as a basic component for combination with resins or metals to form a reinforced composite matrix. Most carbon filament is produced by heat-treating multi-filaments of acrylonitrile synthetic fiber or so-called "pitch fiber" in an oxidizing atmosphere at a temperature of 200° C. to 400° C. for imparting an anti-flame property, and then heating them in an inert atmosphere at a temperature of 800° C. to 2800° C. for carbonization. As with conventional synthetic fiber, the resultant carbon filament is often wound on a bobbin to form a yarn package of a square-end cheese type for easy handling.

A carbon filament, however, has properties quite different from conventional synthetic textile filaments, that is, the carbon filament has an extremely high Young's modulus, very low elongation, and weakness for bending as well as an extremely high surface smoothness comparing to those of the textile filaments. This means that the ability of carbon filament yarn for self-adjusting during a winding operation is poor. Therefore, it is difficult to control winding conditions for forming a package of carbon filament yarn with a winder, particularly, a winding tension of the yarn to obtain a good package of carbon filament yarn. For example, when a carbon filament yarn package is formed under a low winding tension, the yarn tends to slip over the shoulders of the package. On the other hand, a high winding tension causes breakage of component filament of the yarn during the winding operation, resulting in considerable fluff in the package.

Further, increased consumption of carbon filament has led to demands for large packaging, such as packages of 1 to 10 kg in weight. The larger the package, however, the greater the above-mentioned drawbacks. Even if a properly shaped package can be obtained, the yarn tends to slip over from the shoulders upon transport or in an unwinding process, because the package is very sensitive to mechanical shock and the yarn portions distributed therein easily move in relation to each other. With a deformed package, breakage of component filament of the yarn and fluff may occur during the unwinding operation.

In another area, the heat-treating process is a bottleneck in the production of carbon filament, because the process has to be carried out at a low temperature of 200° C. to 400° C. for a long period, such as from several tens of minutes to several hours. If the process is carried out at a higher temperature to reduce the processing time, serious trouble such as combustion or explosion may occur due to a run-away reaction. Under such circumstances, it is convenient to treat a plurality of carbon filament yarns in parallel in the furnace to increase productivity.

When treating a plurality of carbon filament yarns in parallel, a so-called "multi-cop winder" having a long spindle supported in a cantilever manner and a pressure roll provided along the spindle, on which spindle a plurality of bobbins are held longitudinally, may be utilized to take up the resultant carbon filament yarns.

In the multi-cop winder, however, it is difficult to control the winding conditions of the packages on the spindle, whereby a difference in quality may arise between the resultant packages. In the case of large packaging, the spindle tends to bend due to the increased weight of the packages thereon, and the pressure acting between the surface of the packages and the pressure roll. Naturally, the displacement according to the bending is maximum at the free end portion of the spindle and decreases toward the root portion thereof. This causes a difference between the packages in the running yarn length between the fulcrum of yarn traversing and the surface of the package, and this causes a large difference in winding tension between the packages. In case of winding of the conventional textile yarn, the difference between the packages in the running yarn length between the fulcrum of yarn traversing and the surface of the package does not substantially cause a difference in winding tension between the packages, however, in case of winding of the carbon yarn, it causes a large difference in winding tension between the packages, since the carbon yarn has a very high Young's modulus comparing to that of the textile yarn.

SUMMARY OF THE INVENTION

It is an object of the present invention to provide a yarn package of carbon filament of good shape, which, even in large packages, does not substantially deform during transport or unwinding and ensures less breakage of component filaments of the yarn and less fluff.

It is another object of the present invention to provide a method for forming the above package.

The above-mentioned objects of the present invention are achieved by providing a yarn package comprising a bobbin and a continuous carbon filament yarn wound in layers of helical coils on the bobbin in a form of a square-end cheese in which the yarn is placed with a shifting ratio within a range from 50% to 150%, wherein the shifting ratio is determined by the percentage of displacement in a longitudinal direction of the package between a yarn position in a layer of winding of the yarn and another yarn position in another layer of winding of the yarn formed after N traverse cycle(s) from the former yarn position, in a ratio to the width of the yarn, and wherein N is a positive integer selected from a range of from 1 to 9. The term "shifting ratio" as used herein means the longitudinal distance shifted divided by the yarn width, times 100.

The yarn package according to the present invention preferably has the shifting ratio within a range of from 75% to 125% and/or the traverse cycles N being within a range of from 2 to 6. The yarn package according to the present invention preferably has an initial winding angle of not more than 30°, more preferably not less than 10° and further more preferably not more than 17°, and a final winding angle of not less than 4°, more preferably not more than 12° and further preferably not less than 5°. The yarn package according to the present invention preferably has the yarn width within a range of from 1 mm to 5 mm, more preferably within a range of from 2 mm to 4 mm. The yarn package according to the present invention preferably has a wound yarn volume of more than 0.1 kg per inch of the package width and package hardness within a range of from 50° to 85°, more preferably within a range of from 65° to 75°.

The above package can be obtained by utilizing a spindle drive winder comprising a positively rotatable spindle, a bobbin fitted on the spindle, a freely rotatable pressure roll provided along the spindle and a yarn traversing guide for reciprocating the yarn in the direction of the axis of the bobbin, whereby a carbon filament yarn is wound on the bobbin or bobbins fitted on the spindle with a constant winding ratio to form the package or packages, characterised in that the winding ratio is selected so that the yarn is placed with the shifting ratio within a range of from 50% to 150% and the traverse cycle(s) N is selected in a range of from 1 to 9.

In the above method, a winding tension is preferably within a range of from 0.03 g/D to 0.3 g/D, more preferably from 0.07 g/D to 0.2 g/D at the initial stage of the winding operation and preferably within a range of from 0.015 g/D to 0.3 g/D, more preferably from 0.03 g/D to 0.2 g/D at the final stage of the winding operation.

A multi-cop winder comprising a spindle having an effective length more than 400 mm is favourably utilized for carrying out the inventive method. In this case, the package having a weight of more than 0.1 kg per inch of package width is formed under the condition that a deviation of the spindle relative to a pressure roll is within a range of from 1/5000 to 1/500.

In this case, further, a gap between a pressure roll and a surface of each package on the spindle is kept preferably within 2.0 mm, the variance thereof being within 0.2 mm.

BRIEF DESCRIPTION OF THE DRAWINGS

Other features and objects of the present invention will now be apparent from the description of the embodiments according to the present invention with reference to the accompanying drawings, in which.

DESCRIPTION OF THE PREFERRED EMBODIMENT

Figure 1:
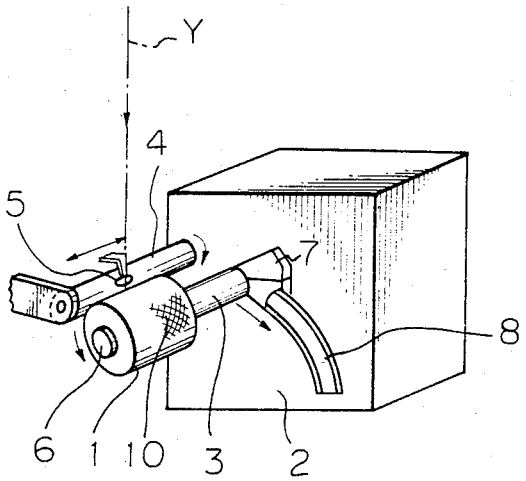
FIG. 1 is a perspective view of a conventional spindle drive type winder utilized for carrying out the present invention.

A yarn package 1 of carbon filament yarn is formed by means of a conventional spindle drive winder shown in FIG. 1. The winder comprises a spindle 3, one end of which is rotatably supported in a housing 2 accommodating a means for driving the spindle, such as a torque motor (not shown), and the other end being free, and a pressure roll 4 disposed parallel to the spindle 3 in a freely rotatable manner.

In the vicinity of an outer surface of the pressure roll 4 is a traverse guide 5 engaged with a scroll groove of a traverse cam (not shown) so as to be able to move reciprocatively on a predetermined path arranged parallel to the spindle 3. A carbon filament yarn Y which is preferably originated from acrylonitrile synthetic fiber is delivered from a preceding process, such as a carbonization, at a constant rate and is taken up, through the traverse guide 5 on a bobbin 6 fitted on the spindle 3, whereby a cross-wound package 1 of a square-end cheese type is obtained. As a diameter of the package 1 increases, a rotational frequency of the spindle 3 is controlled to decrease so that a peripheral speed of the package 1 can be kept constant. The spindle 3 also displaces away from the pressure roll 5 by being guided by means of a dog-segment 8 provided on a wall of the housing 2, to which a dog 7 of the spindle 3 is slidably engaged, so that a gap between a surface of the package 8 and the pressure roll 4 can be kept constant (the gap is preferably less than 1 mm). A function of the pressure roll 4 is to gradually level unevenness on the package surface and to control the hardness of the package.

Figure 2A:
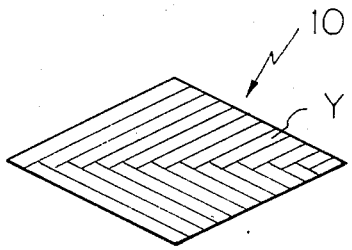
FIG. 2A is an enlarged view of a mesh-like crossing pattern appearing on the surface of a yarn package when the shifting ratio is 50% of the yarn width.
Figure 2B:
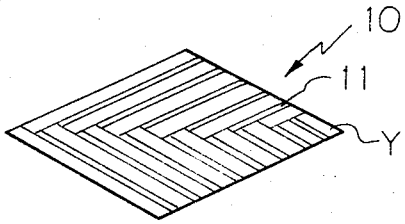
FIG. 2B is the similar view as FIG. 2 when a yarn shifting ratio is 150% of the width.

The yarn is wound onto the bobbin in layers of helical coils by the reciprocating traverse guide. A layer of winding of the yarn is formed by a forward traverse motion or stroke and the next layer of winding of the yarn is formed by a backward traverse motion or stroke. A traverse cycle is completed with the successive two strokes. The yarn is distributed in a ribbon shape successively on the layers previously formed and forms a yarn trace in helical coil at each stroke. The successive yarn traces cross with each other to form a mesh-like crossing pattern 10 on the package surface as shown in FIGS. 2A and 2B.

The present inventors have found that the desired yarn package can be obtained by controlling the position of the yarn trace. That is, the desired package can be obtained by ensuring that each yarn trace is formed close to a prior trace formed a small number of traverse before. The yarn traces are not desirably formed at exactly corresponding positions since the resultant overlapping of yarn portions would result in an uneven package surface. Therefore, it is necessary to shift the yarn traces from each other with a shifting ratio of from 50% to 150%, preferably from 75% to 125%, relative to the yarn width. The corresponding yarn traces must be formed within not more than nine, preferably in a range of from 2 to 6, traverse. The yarn width is preferably in a range of from 1 mm to 5 mm in a layer of winding of the yarn measured in a direction perpendicular to the longitudinal direction of the yarn trace, more preferably in a range of from 2 mm to 4 mm.

If the shifting ratio is less than 50%, namely, if a yarn trace is wound onto the corresponding prior trace with an overlapped distance more than a half of the yarn width, the filaments in the yarn tend to entangle upon unwinding from the resultant package, which causes considerable fluff in the yarn. Further, the surface of the package becomes uneven due to so-called "ribbon wind", which results in a deformed package having a low apparent density.

On the other hand, if the shifting ratio exceeds 150%, namely, if the two yarn traces have a gap 11 (see FIG. 2B) wider than a half of the yarn width, the yarn portion tends to slip on the package due to lack of constraint force, also causing a deformed package. This phenomenon becomes more evident in forming larger packages.

The shifting ratio is preferably selected in accordance with the yarn thickness. For example, the shifting ratio is preferably from 50% to 100% relative to the yarn width for yarn of about 3600 total denier and from 100% to 150% for yarn of about 7200 total denier. Generally speaking, a larger shifting ratio is preferable for larger yarn width.

FIGS. 2A and 2B show mesh-like crossing patterns corresponding to shifting ratios of 50% and 150%, respectively.

A method for forming the package is described below. The package is formed by using the spindle drive winder illustrated in FIG. 1. This winder is of a constant winding ratio type, that is, a predetermined winding ratio is maintained throughout the winding operation, while the winding angle gradually decreases as the diameter of the package increases. Here, the winding ratio means the number of revolutions of the package per unit traverse.

The desired shifting ratio is obtained by selecting s suitable winding ratio. A method for the selection is explained below:

A winding ratio $W_0$ without consideration of yarn width is determined by equation (1)

$$W_0 = \frac{2L}{D_0 \tan \theta} \quad (1)$$

where L is traverse width in mm, $D_0$ is the outer diameter of the bobbin in mm, and $\theta$ is the initial winding angle.

The adjusting value dW is determined by equation (2)

$$dW = \frac{W_0 y}{2L N} \quad (2)$$

where y the shifting distance in mm and N is the integer mentioned before. Conversely, the shifting distance y can be determined from the shifting ratio: y=yarn width x shifting ratio.

The desired winding ratio $W_1$ is calculated by equation (3)

$$W_1 = W_0 \pm dW \quad (3).$$

In equation (3), $W_1$ obtained from ($W_0$−dW) is preferably used.

In the above case, the initial winding angle is preferably selected to be in a range of from 10° to 30°, which corresponds to a final winding angle of from 4° to 12°. This is because, if the winding angle exceeds the above range, a bulge tends to develop on the shoulders of the package, which damages the yarn. On the other hand, if the winding angle is below the range, the yarn on the package tends to slip over from the shoulders.

A suitable winding ratio $W_1$ when a yarn of 2 mm width is wound on a bobbin of 82 mm diameter with a traverse width of 152 mm, a winding angle of 15° and a shifting ratio of 75% is calculated by equations (1), (2), and (3) as follows:

$$W_0 = \frac{2 \times 152}{3.14 \times 82 \times \tan 15} = 4.4$$

$$dW = \frac{4.4 \times (2 \times 0.75)}{2 \times 152 \times 5} = 0.0043$$

$$W_1 = 4.4 - 0.0043 = 4.3957.$$

When the winding operation is carried out under a winding ratio of 4.3957 according to the invention, the yarn package is formed in such a manner that the yarn trace is repeated with a shifting ratio of 75%. Actually, the winding ratio is selected, with reference to the above calculated result, from the group of suitable gear combinations listed on the table attached to the winder.

EXAMPLE 1

Two carbon filament yarns with yarn widths of 2.0 mm and 4.0 mm, respectively, were wound to form packages under various shifting ratios. The resultant packages were examined for their appearance and unwinding smoothness. The results are shown in Table 1.

TABLE 1

| Package No. | Yarn width (mm) | shifting distance (mm) | shifting ratio (%) | Dia. of bobbin (mm) | Traverse length (mm) | Dia. of package (mm) | Weight of Wound yarn (g) | Winding ratio | Winding angle (Initial) | Winding angle (Final) | N | Appearance | Smoothness in unwinding operation | Note |
|---|---|---|---|---|---|---|---|---|---|---|---|---|---|---|
| 1 | 2.0 | 1.35 | 67.5 | 82 | 152 | 160 | 2000 | 4.3269 | 15.3 | 8.0 | 3 | o | o | |
| 2 | 2.0 | 2.7 | 135 | 82 | 152 | 160 | 2000 | 4.3205 | 15.3 | 8.0 | 3 | o | o | |
| 3 | 2.0 | 0.68 | 34 | 82 | 152 | 160 | 2000 | 4.3301 | 15.3 | 8.0 | 3 | x | x | Comparative Example |
| 4 | 4.0 | 2.9 | 75.3 | 86 | 304 | 190 | 6000 | 8.3200 | 15.1 | 7.0 | 3 | o | o | |
| 5 | 4.0 | 1.35 | 35.5 | 86 | 304 | 190 | 6000 | 8.6538 | 14.6 | 6.7 | 3 | x | x | Comparative Example |

Note:
o means excellent;
x means bad.

As apparent from Table 1, packages No. 1, 2, and 4, formed with shifting ratios according to the present invention, showed good appearance and excellent unwinding smoothness.

The package according to the present invention preferably has a hardness in a range of from 50° to 85°, more preferably from 65° to 75°, especially when it is formed of a yarn having a total denier (D) within a range of from 500 to 20000 and is of a weight of more than 0.1 kg per inch of the package width. The hardness referred to herein is a value measured a Model C Hardness Tester provided by Kobunshi Keiki Seisakusho, Japan. Three circumferentially spaced points on each of the two shoulders and a center of the package surface were selected as measured points. The average value was utilized as a representative of the package hardness.

If the hardness is smaller than 50°, the package is poor in appearance and tends to be deformed by slipping-over. On the other hand, if the hardness exceeds 85°, the yarn portion in the package tends to adhere to the adjacent portion, whereby smooth unwinding thereof cannot be expected. Thus, a hardness of from 50° to 85° assures a good appearance and smooth unwinding of the package as well as possibility of large packaging.

In order to obtain a package with a hardness within a range of from 50° to 85°, the winding tension of the yarn has to be controlled to within a range of from 0.03 g/D to 0.3 g/D at the first stage of the winding operation and to within a range of from 0.015 g/D to 0.3 g/D at the final stage thereof. Further, to obtain a package with a hardness in a range of from 65° to 75°, the winding tension has to be controlled to within a range of from 0.07 g/D to 0.2 g/D at the first stage and to within a range of from 0.03 g/D to 0.2 g/D at the final stage. The winding tension may be constant throughout the winding operation, but preferably decreases in accordance with the progress of the winding operation as described above.

EXAMPLE 2

A carbon filament yarn having a total denier of 3000 composed of 6000 filaments was wound by the winder shown in FIG. 1 with six initial tensions in a range of from 0.01 g/D to 0.4 g/D and with a final tensions controlled to be a half of the initial tensions. Packages were obtained corresponding to the six tension modes.

The properties of the packages were tested. The results are indicated in Table 2.

TABLE 2

| Initial tension (g/D) | Hardness (°) | Volume of Wound yarn (kg/in) | Appearance | Smoothness of rewinding |
|---|---|---|---|---|
| 0.01 | 40 | 0.3 | Poor | Very good |
| 0.03 | 50 | 1.0 | Good | Good |
| 0.07 | 65 | 1.0 | Very good | Very good |
| 0.2 | 75 | 1.0 | " | Very good |
| 0.3 | 85 | 1.0 | " | Good |
| 0.4 | 90 | 1.0 | " | No good |

As apparent from the table, in the case of a lower initial tension of 0.01 g/D, the yarn on the growing package tended to slip-over. Therefore, a volume of wound yarn of more than 0.3 kg-weight per inch of the package width could not be obtained. Contrary to this, the package wound with an initial tension of 0.4 g/D had a hardness of more than 90°, which generated considerable fluff during the unwinding thereof. Thus, the initial winding tension is preferably within a range of from 0.03 g/D to 0.3 g/D, more preferably, from 0.07 g/D to 0.2 g/D.

Another aspect of the present invention carried out by means of a multi-cop winder illustrated in FIG. 3 will now be explained.

The multi-cop winder is substantially of the same construction as the spindle winder shown in FIG. 1, except that the former has a longer spindle 3 supported in a cantilever manner. A plurality of bobbins (in this case, four bobbins) are mounted thereon corresponding to each yarn to be wound to form packages 1*a* to 1*d*. The multi-cop winder is preferably utilized for simultaneously winding a plurality of carbon filament yarns delivered from the carbonizing furnace at a relatively slow speed, so that the overall productivity of the process is increased.

A function of the pressure roll 4 is to level unevenness of the surface of a package, as stated before. In the multi-cop winder, another very important function is to impart a constant surface pressure (preferably within a range of from 0.1 to 0.3 kg/cm) onto the every packages on the spindle to obtain uniform size packages. For this purpose, the gap between the package surface and the pressure roll has to be kept less than 2.0 mm, preferably less than 1 mm, and the variance thereof has to be kept within 0.2 mm, otherwise the hardness of the resultant package may fluctuate more than 5%. However, in case of a longer spindle, the effective length of which exceeds 400 mm, the spindle 3 tends to bend due to the counter force acting on the packages from the pressure roll 4 as well as the increasing weight of the packages. Here, the effective length means a length from a free end of the spindle to a root portion thereof emerging from a bearing supporting the spindle. Therefore, the free end portion of the spindle gradually bends away from the pressure roll, causing a difference in surface pressures between the packages. This causes a difference of diameters between the packages on the spindle. Since the carbon filament yarn has a high Young's modulus, such a diameter difference results in the great difference of the winding tensions for the package, especially in the final stage of the winding operation. It is apparent that the thus obtained packages may include low quality ones, as stated before.

To prevent this, according to the present invention, the relative positions of the spindle and the pressure roll are previously deviated to be nonparallel, so as to compensate for the bending of the spindle especially at the final stage. The deviation may be provided so that the gap between the root portions of the spindle and of the pressure roll is greater than that between the free end portion of the spindle and the pressure roll. It is also possible to adjust the spindle so that the free end thereof is positioned above the normal level relative to the pressure roll with or without the above deviation of the root portion of the spindle.

Figure 4:
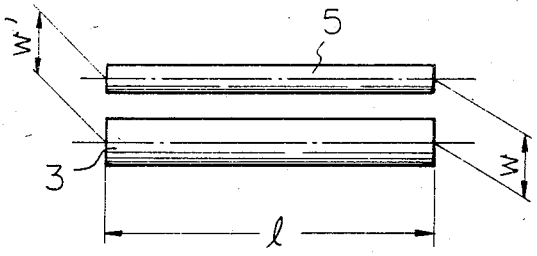
FIG. 4 is a diagram of the clearance between a spindle and a pressure roll of the multi-cop winder shown in FIG. 3 for explaining a deviation therebetween.

The dimensional relationship of the spindle and the pressure roll is explained in detail referring to FIG. 4. The deviation Δ of the spindle 3 from an imaginary line parallel to the pressure roll 4 is defined by the following equation $$\Delta = \frac{|W - W'|}{l}$$

where l is an effective length of the spindle 3, and W and W' are gaps between the spindle 3 and the pressure roll 4 at the free end portion and the root portion thereof, respectively. The deviation Δ is preferably within a range of from 1/5000 to 1/500. Of course, the direction of this deviation is decided by taking that of the resultant force which causes the bending of the spindle into account, so that the deviation can cancel the bending throughout the winding operation.

EXAMPLE 3

Figure 3:
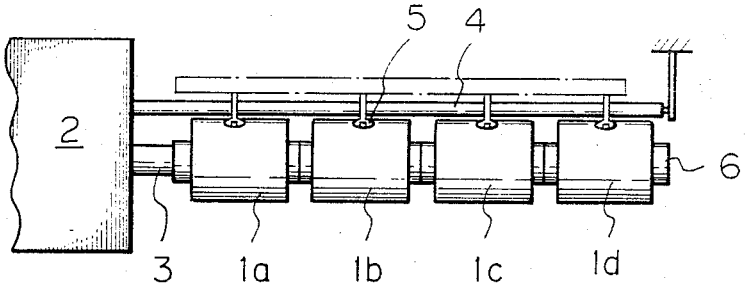
FIG. 3 is a schematic plan view of a multi-cop winder utilized for carrying out the present invention.

Four carbon filament yarns each having a total denier of 3000 and composed of 6000 filaments were simultaneously taken up by the multi-cop winder shown in FIG. 3 without prior adjustment of the spindle under an initial winding tension of 0.2 g/D and a final winding tension of 0.1 g/D. The winding operation was carried out until the volume of wound yarn reached a weight of 1.0 kg per inch of package width. The winder was controlled to maintain the gap between the pressure roll and the packages within 1 mm. The actual variance of the gap, however, amounted to 0.3 mm.

After the packages of the first group were doffed, the winder was adjusted so that the spindle had a deviation Δ of 1/1000 relative to the pressure roll. Packages of a second group were formed in the same manner as before. In this case, the variance of the gap was kept within 0.1 mm throughout the winding operation.

The two groups of the resultant package were evaluated in relation to the hardness and the unwinding tension. The results are listed in Table 3.

TABLE 3

| Package No. | Hardness (°) | Unwinding tension (g/D) |
|---|---|---|
| First group | | |
| 1 | 78.0 | 8 |
| 2 | 77.0 | 8 |
| 3 | 73.0 | 5 |
| 4 | 68.0 | 3 |
| Second group | | |
| 1 | 73.5 | 5 |
| 2 | 73.3 | 5 |
| 3 | 73.0 | 5 |
| 4 | 72.5 | 5 |

From the table, it is apparent that the hardness and the unwinding tension of the packages largely fluctuated in the case of the first group compared to the second group according to the present invention.

We claim:

1. A yarn package comprising a bobbin and a continuous carbon filament yarn wound in layers of helical coils on the bobbin the form of a of square-end cheese in which the yarn is placed with a shifting ratio within a range of from 50% to 150% wherein the shifting ratio is determined by the shifting distance shifted in a longitudinal direction of the package from a yarn position in a layer of winding of the yarn to another yarn position in another layer of winding of the yarn formed after N traverse cycle(s) from the former yarn position, divided by the width of the yarn times 100 and wherein the N is a positive integer, and in which the N is in a range of from 1 to 9.

2. A yarn package according to claim 1, in which the shifting ratio is within a range of from 75% to 125%.

3. A yarn package according to claim 1, in which the N is within a range of from 2 to 6.

4. A yarn package according to claim 1, in which the package has an initial winding angle of not more than 30° and a final winding angle of not less than 4°.

5. A yarn package according to claim 4, in which the initial winding angle is not less than 10° and the final winding angle is not more than 12°.

6. A yarn package according to claim 5, in which the initial winding angle is not more than 17°.

7. A yarn package according to claim 5, in which the final winding angle is not less than 5°.

8. A yarn package according to claim 1, in which the yarn width is within a range of from 1 mm to 5 mm.

9. A yarn package according to claim 8, in which the yarn width is within a range of from 2 mm to 4 mm.

10. A yarn package according to claim 1, in which the wound yarn volume of the package is more than 0.1 kg per inch of package width and the hardness of the package is within a range of from 50° to 85°.

11. A yarn package according to claim 10, in which the hardness is within a range of from 65° to 75°.

12. A yarn package according to claim 1, in which the carbon filament yarn is originated from acrylonitrile synthetic fibers.

13. A yarn package according to claim 1, in which the carbon filament yarn has a total denier of about 3600 and the shifting ratio is within a range of from 50% to 100%.

14. A yarn package according to claim 1, in which the carbon filament yarn has a total denier of about 7200 and the shifting ratio is within a range of from 100% to 150%.

15. A yarn package comprising a support and a continuous carbon filament yarn wound in successive layers of helical coils on the support in the form of a square-end cheese in which the yarn coils in some layers are shifted with respect to the yarn coils of other layers, the shifted coils being positioned at a shifting ratio of from 50% to 150%, the shifting ratio being the shifting distance between a first yarn coil position in a layer and a successive yarn coil position in a successive layer, divided by the width of the yarn, the number of layers between said first layer and said successive layer being from 1 to 9.

* * * * *

UNITED STATES PATENT AND TRADEMARK OFFICE

CERTIFICATE OF CORRECTION

PATENT NO. : 4,586,679

DATED : 5/6/86

INVENTOR(S) : Ryuichi Yamamoto and Hironobu Nojiri

It is certified that error appears in the above-identified patent and that said Letters Patent is hereby corrected as shown below:

Column 9, line 23, after "bobbin" insert --in--; delete "of".

Signed and Sealed this

Seventh Day of April, 1987

*Attest:*

DONALD J. QUIGG

*Attesting Officer*

*Commissioner of Patents and Trademarks*